US007906952B2

(12) United States Patent
Kuo et al.

(10) Patent No.: US 7,906,952 B2
(45) Date of Patent: Mar. 15, 2011

(54) VOLTAGE REGULATOR

(75) Inventors: Kuo-Jen Kuo, Taipei (TW); Yu-Lung Hung, Taipei (TW); Kang-Shou Chang, Taipei (TW)

(73) Assignee: Prolific Technology Inc., Taipei (TW)

( * ) Notice: Subject to any disclaimer, the term of this patent is extended or adjusted under 35 U.S.C. 154(b) by 233 days.

(21) Appl. No.: 12/400,809

(22) Filed: Mar. 10, 2009

(65) Prior Publication Data

US 2010/0176775 A1 Jul. 15, 2010

(30) Foreign Application Priority Data

Jan. 14, 2009 (TW) ..... 98101221 A

(51) Int. Cl.
*G05F 1/40* (2006.01)

(52) U.S. Cl. ..... 323/284; 323/274

(58) Field of Classification Search ..... 323/273–277, 323/280, 282, 284, 285
See application file for complete search history.

(56) References Cited

U.S. PATENT DOCUMENTS

| | | | | |
|---|---|---|---|---|
| 5,717,319 | A | 2/1998 | Jokinen | |
| 6,998,826 | B2 * | 2/2006 | Fukui | 323/282 |
| 7,262,586 | B1 * | 8/2007 | Gradinariu | 323/280 |
| 7,629,711 | B2 * | 12/2009 | Zhong et al. | 307/103 |
| 2008/0180079 | A1 * | 7/2008 | Kurozo et al. | 323/284 |

FOREIGN PATENT DOCUMENTS

| | | |
|---|---|---|
| TW | 520562 | 2/2003 |
| TW | 200720877 | 6/2007 |

* cited by examiner

*Primary Examiner* — Jessica Han
(74) *Attorney, Agent, or Firm* — Jianq Chyun IP Office

(57) ABSTRACT

A voltage regulator includes a comparator, a first voltage output unit, a second voltage output unit, a third voltage output unit, a first switch and a second switch. The voltage regulator receives an operating voltage and a reference voltage generated by a reference voltage generator, and then outputs a corresponding output voltage. The voltage regulator of the present invention can provide an operation mode, a suspend mode and a standby mode and can be switched among these modes to provide corresponding current driving capacity for respective operation states. When in the operation mode, the voltage regulator can supply a great current. When in the suspend mode, the voltage regulator consumes less power. When in the standby mode, the voltage regulator consumes even less power.

24 Claims, 3 Drawing Sheets

VOLTAGE REGULATOR

CROSS-REFERENCE TO RELATED APPLICATION

This application claims the priority benefit of Taiwan application serial no. 98101221, filed on Jan. 14, 2009. The entirety of the above-mentioned patent application is hereby incorporated by reference herein and made a part of specification.

BACKGROUND OF THE INVENTION

1. Field of the Invention

The present invention relates generally to a voltage regulator, and particularly to a voltage regulator which is power saving and operable in different modes.

2. Description of Related Art

In the design of current consumer electronic products, power consumption is an important factor to be considered. For example, in handheld products, it is common to specify a limit on the power consumption of each circuit in the handheld product. For instance, when a circuit needs to operate, the power supply for that circuit is turned on, and when the circuit does not need to operate, the power supply is turned off. Therefore, a voltage regulator is required to turn on or turn off the power. However, in designing the voltage regulator, for the consideration of the circuit stability, most voltage regulator can only operate in one single mode. In addition, the maximum load current is proportional to the current consumption of the voltage regulator. Therefore, in designing the voltage regulator, the current consumption of the voltage regulator is often designed to be very large. The power consumed by this type of voltage regulator is constant no matter how much power the instantaneous load consumes. That is, when the load needs a large current, the current consumed by the voltage regulator is constant. However, as the load current becomes smaller, the current consumption of the voltage regulator still maintains constant, which appears to be unduly large when compared to the current consumption of the voltage regulator itself. Therefore, the type of voltage regulator is not power-saving.

SUMMARY OF THE INVENTION

The present invention is directed to a voltage regulator which can be switched among an operation mode, a suspend mode and a standby mode to provide corresponding current driving capacity for respective operation states. When in the operation mode, the voltage regulator can supply a great current. When in the suspend mode, the voltage regulator consumes less power. When in the standby mode, the voltage regulator consumes even less power.

The present invention provides a voltage regulator including a comparator, a first voltage output unit, a second voltage output unit, a first switch, and a second switch. The comparator includes a first input end, a second input end, and an output end. The first input end is used to receive a reference voltage. The first voltage output unit includes a first P-type transistor, a first resistor, and a second resistor. The first P-type transistor has a source coupled to an operating voltage, a drain coupled to the first resistor, and a gate coupled to the output end of the comparator. The second resistor is coupled between the other end of the first resistor and a ground. A common node of the first resistor and the second resistor is coupled to the second input end of the comparator.

The second voltage output unit includes a second P-type transistor, a capacitor, and a current buffer. The second P-type transistor has a source coupled to the operating voltage and a drain coupled to the capacitor. The other end of the capacitor is coupled to the ground. The current buffer is coupled between the drain of the first P-type transistor and the drain of the second P-type transistor. An output end of the current buffer is coupled to a gate of the second P-type transistor and adjusts the gate voltage of the second P-type transistor according to the drain voltage of the first P-type transistor and the drain voltage of the second P-type transistor. The first switch is coupled between the gate of the first P-type transistor and a gate of the second P-type transistor. The second switch is coupled between the drain of the first P-type transistor and the drain of the second P-type transistor.

According to one embodiment of the present invention, the voltage regulator further includes a third voltage output unit. The third voltage output unit includes a third resistor and a fourth resistor. The third resistor has one end coupled to a second operating voltage. The fourth resistor is coupled between the other end of the third resistor and the ground. A common node of the third resistor and the fourth resistor is coupled to the drain of the second P-type transistor.

According to one embodiment of the present invention, the third resistor of the third voltage output unit is a variable resistor. The third voltage output unit further includes a comparison unit coupled to the variable resistor. The comparison unit is adapted to compare the second operating voltage with the reference voltage and output an adjustment signal to the variable resistor to adjust the resistance of the variable resistor.

According to one embodiment of the present invention, the comparison unit includes a comparison circuit and a storage device. The comparison circuit is adapted to compare the second operating voltage with the reference voltage and output an adjustment value. The storage device is adapted to store the adjustment value and output the adjustment signal to the variable resistor according to the adjustment value to adjust the resistance of the variable resistor.

According to one embodiment of the present invention, when both the first switch and the second switch are turned off, the voltage regulator is in an operation mode.

According to one embodiment of the present invention, when both the first switch and the second switch are turned on, the voltage regulator is in a suspend mode.

According to one embodiment of the present invention, when the voltage regulator is in the suspend mode, the current buffer is disabled.

According to one embodiment of the present invention, when the first voltage output unit and the second voltage output unit are disabled and the second switch is turned off, the voltage regulator is in a standby mode.

According to one embodiment of the present invention, the current buffer includes a third P-type transistor, a fourth P-type transistor, an N-type transistor, a first current source, a second current source, and a bias voltage. The third P-type transistor has a source coupled to the drain of the first P-type transistor and a drain coupled to a gate of the third P-type transistor and the first current source. The fourth P-type transistor has a gate coupled to the gate of the third P-type transistor, a source coupled to the drain of the second P-type transistor, and a drain coupled to the second current source. The N-type transistor has a gate coupled to the bias voltage, a drain coupled to the third current source and the gate of the second P-type transistor, and a source coupled to the drain of the fourth P-type transistor.

According to one embodiment of the present invention, the voltage regulator further includes a reference voltage generator coupled to the first input end of the comparator for generating the reference voltage.

According to one embodiment of the present invention, the operating voltage is equal to the second operating voltage.

According to one embodiment of the present invention, the comparator is an operational amplifier. The first input end of the comparator is a non-inverting input end of the operational amplifier, the second input end of the comparator is an inverting input end of the operational amplifier, and the output end of the comparator is an output end of the operational amplifier.

The present invention also provides another voltage regulator including a comparator, a first voltage output unit, a second voltage output unit, a third voltage output unit, a first switch, and a second switch. The comparator has a first input end, a second input end, and an output end. The first input end is adapted to receive a reference voltage.

The first voltage output unit includes a first P-type transistor, a first resistor, and a second resistor. The first P-type transistor has a source coupled to an operating voltage, a drain coupled to the first resistor, and a gate coupled to the output end of the comparator. The second resistor is coupled between the other end of the first resistor and a ground. A common node of the first resistor and the second resistor is coupled to the second input end of the comparator.

The second voltage output unit includes a second P-type transistor, a capacitor, and a current buffer. The second P-type transistor has a source coupled to the operating voltage and a drain coupled to the capacitor. The other end of the capacitor is coupled to the ground.

In addition, the current buffer includes a third P-type transistor, a fourth P-type transistor, an N-type transistor, a first current source, a second current source, a third current source, and a bias voltage. The third P-type transistor has a source coupled to the drain of the first P-type transistor, and a drain coupled to a gate of the third P-type transistor and the first current source. The fourth P-type transistor has a gate coupled to the gate of the third P-type transistor, a source coupled to the drain of the second P-type transistor, and a drain coupled to a second current source. An N-type transistor has a gate coupled to the bias voltage, a drain coupled to the third current source and a gate of the second P-type transistor, and a source coupled to the drain of the fourth P-type transistor.

The third voltage output unit includes a third resistor and a fourth resistor. The third resistor has one end coupled to a second operating voltage. The fourth resistor is coupled between the other end of the third resistor and the ground. A common node of the third resistor and the fourth resistor is coupled to the drain of the second P-type transistor.

The first switch is coupled between the gate of the first P-type transistor and the gate of the second P-type transistor. The second switch is coupled between the drain of the first P-type transistor and the drain of the second P-type transistor.

In summary, the voltage regulator of the present invention can be switched among the operation mode, the suspend mode and the standby mode to provide corresponding current driving capacity for respective operation states. When in the operation mode, the voltage regulator can supply a great current. When in the suspend mode, the voltage regulator consumes less power. When in the standby mode, the voltage regulator consumes even less power.

In order to make the aforementioned and other features and advantages of the present invention more comprehensible, embodiments accompanied with figures are described in detail below.

DESCRIPTION OF THE EMBODIMENTS

Figure 1:
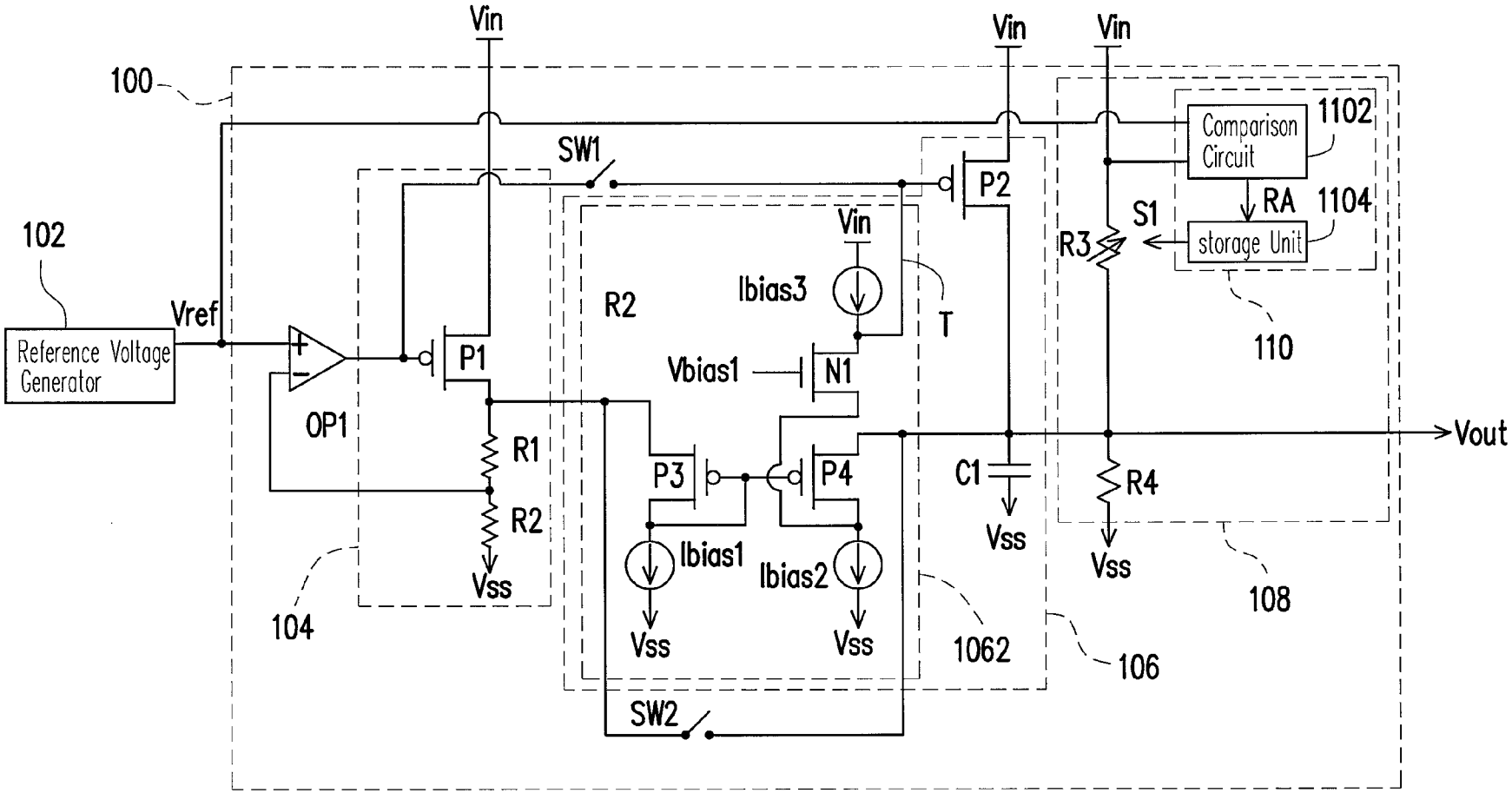
FIG. 1 is a block diagram of a voltage regulator according to one embodiment of the present invention.

FIG. 1 is a block diagram of a voltage regulator according to one embodiment of the present invention. Referring to FIG. 1, the voltage regulator 100 includes an operational amplifier OP1, a first voltage output unit 104, a second voltage output unit 106, a first switch SW1, a second switch SW2, and a third voltage output unit 108. The operational amplifier OP1 may be a comparator where a first input end of the comparator is a non-inverting input end of the operational amplifier OP1 and a second input end of the comparator is an inverting input end of the operational amplifier OP1. In the present embodiment, the non-inverting input end of the operational amplifier OP1 is used to receive a reference voltage Vref generated by a reference voltage generator 102. The voltage regulator 100 operates between the operating voltage Vin and the ground Vss. The voltage regulator 100 generates an output voltage Vout based on the reference voltage Vref, and switches operating modes of the voltage regulator 100 to thereby adjust its current supply capacity in response to an amount of the load.

The first voltage output unit 104 includes a P-type transistor P1, a resistor R1, and a resistor R2. The P-type transistor P1 includes a source coupled to the operating voltage Vin, a drain coupled to the resistor R1, and a gate coupled to the output end of the operational amplifier OP1. In addition, the resistor R2 is coupled between the other end of the resistor R1 and the ground Vss, and a common node of the resistor R1 and the resistor R2 is coupled to an inverting input end of the operational amplifier OP1. As such, the operational amplifier OP1 and the voltage output unit 104 collectively form a negative feedback circuit which uses the feedback circuit formed by the resistor R1 and the resistor R2 to feed the voltage back to the inverting input end of the operational amplifier OP1.

The second voltage output unit 106 includes a P-type transistor P2 and a current buffer 1062. The P-type transistor P2 includes a source coupled to the operating voltage Vin and a drain coupled to a capacitor C1. The other end of the capacitor C1 is coupled to the ground Vss. The current buffer 1062 is coupled between the drain of the P-type transistor P1 and the drain of the P-type transistor P2. An output end T of the current buffer 1062 is coupled to a gate of the P-type transistor P2 and adjusts the gate voltage of the P-type transistor P2 according to the drain voltage of the P-type transistor P1 and the drain voltage of the P-type transistor P2.

The first switch SW1 is coupled between the gate of the P-type transistor P1 and the gate of the P-type transistor P2, and the second switch SW2 is coupled between the drain of the P-type transistor P1 and the drain of the P-type transistor P2.

The third voltage output unit 108 includes a resistor R3, a resistor R4, and a comparison unit 110. The resistor R3 is a variable resistor having one end coupled to the operating voltage Vin. The resistor R4 is coupled between the other end of the third resistor R3 and the ground Vss. A common node of the resistor R3 and the resistor R4 is coupled to the drain of the P-type transistor P2. The common node of the resistor R3 and the resistor R4 is also the output end of the voltage regulator 100 for generating an output voltage Vout to drive the load.

The comparison unit 110 is coupled to the resistor R3, for comparing the operating voltage Vin with the reference voltage Vref and outputting an adjustment signal S1 to the resistor R3 to adjust the resistance of the resistor R3. The comparison unit 110 includes a comparison circuit 1102 and a storage device 1104. The comparison circuit 1102 is used to compare the operating voltage Vin with the reference voltage Vref and output an adjustment value RA. The storage device 1104 is used to store the adjustment value RA and output the adjustment signal S1 to the resistor R3 to adjust its resistance according to the adjustment value.

The current buffer 1062 includes a P-type transistor P3, a P-type transistor P4, an N-type transistor N1, a current source Ibias1, a current source Ibias2, a current source Ibias3, and a bias voltage Vbias1. A source of the P-type transistor P3 is coupled to a drain of the P-type transistor P1. A drain of the P-type transistor P3 is coupled to a gate of the P-type transistor P3 and the current source Ibias1. A gate of the P-type transistor P4 is coupled to the gate of the P-type transistor P3. A source of the P-type transistor P4 is coupled to a drain of the P-type transistor P2. A drain of the P-type transistor P4 is coupled to the current source Ibias2.

A gate of the N-type transistor N1 is coupled to the bias voltage Vbias1. A drain of the N-type transistor N1 is coupled to the current source Ibias3 and a gate of the P-type transistor P2. A source of the N-type transistor N1 is coupled to the drain of the P-type transistor P4. The P-type transistors P3 and P4 are arranged into a current mirror structure. Since currents of the current source Ibias1, Ibias2 are constant, when the second switch SW2 is turned off, the voltage of the output end T of the current buffer 1062 varies with the change of the drain voltage of the P-type transistor P1 or P-type transistor P2, thereby adjusting the gate voltage of the P-type transistor P2 to adjust the output voltage Vout.

In the present embodiment, the voltage regulator 100 can be switched to provide corresponding current driving capability for respective operation states. According to the mode of the circuit operation, the voltage regulator 100 can operate in three modes, i.e., an operation mode, a suspend mode, and a standby mode. When both the first switch SW1 and the second switch SW2 are turned off, the first voltage output unit 104, the second voltage output unit 106 and the third voltage output unit 108 are all in a normal operation state. At this time, the voltage regulator 100 operates in the operation mode which can provide a great current, for example, about 100 milliampere (mA), to the load end (the common node of the resistor R3 and resistor R4). The current buffer 1062 can be considered a current feedback circuit. When the load coupled to the output voltage Vout needs an increased load current, the value of the output voltage Vout can be adjusted by means of current feedback such that the output voltage Vout is close to the drain voltage of the P-type transistor P1 (i.e, the output voltage of the first voltage output unit 104).

When the first switch SW1 and the second switch SW2 are turned on, the voltage regulator 100 operates in the suspend mode. At this time, the voltage regulator 100 disables the current buffer 1062 (e.g., cut off power supply) and, therefore, the current buffer 1062 does not consume power at this time. Since the first switch SW1 and the second switch SW2 are turned on, the gate voltage and the drain voltage of the P-type transistor P1, P2 are the same. Therefore, for circuit analysis purpose, the P-type transistors P1, P2 can be considered one P-type transistor with a larger size. In the suspend mode, the voltage regulator 100 consumes less power and supplies a smaller current, for example, about 1 milliampere (mA) to the load end. At the same time, in the suspend mode, the reference voltage generator 102 and the operational amplifier OP1 can also be configured to be in a low current state to reduce power consumption.

In the standby mode, the first voltage output unit 104 and the second voltage output unit 106 are disabled and only the third voltage output unit 108 operates in the normal operation state. The output voltage Vout is determined based on the voltage division by the resistors R3 and R4, and the needed load current is also supplied by the third voltage output unit 108. Since only the third voltage output unit 108 in the voltage regulator 100 needs to consume power, the power consumed by the voltage regulator 100 can be controlled below less than 5 microampere (uA). In the standby mode, the comparison unit 110 of the third voltage output unit 108 adjusts the resistance of the resistor R3 (variable resistor) according to a preset adjustment value to maintain the value of the output voltage Vout within a certain range.

In addition, it is to be understood that disabling the first voltage output unit 104 and the second voltage output unit 106 can be achieved by, for example, shutting off the operating voltage Vin. If this manner is adopted, the voltage source for the first, second voltage output units 104, 106 and the voltage source for the third voltage output unit 108 can be separated apart such that they can be controlled individually. In stead of using the above described different voltage source design to disable the first voltage output unit 104 and the second voltage output unit 106, one same current source can be used and the first voltage output unit 104 and the second voltage output unit 106 are configured to include a disable mechanism, such as, a shut-off circuit such that the first voltage output unit 104 and the second voltage output unit 106 can be disabled.

In the present embodiment, the voltage regulator 100 can be switched to provide corresponding current driving capability for respective operation states. When the load end needs a great current, the voltage regulator 100 can select the operation mode, thereby providing a great current to the load end. When the load end does not need a great current, the voltage regulator 100 can select the suspend mode, thereby reducing the power consumption of the voltage regulator 100. When the load end needs little power, the voltage regulator 100 can select the standby mode in which the voltage regulator 100 consumes only a tiny amount of the current while maintaining the value of the output voltage Vout.

Figure 2:
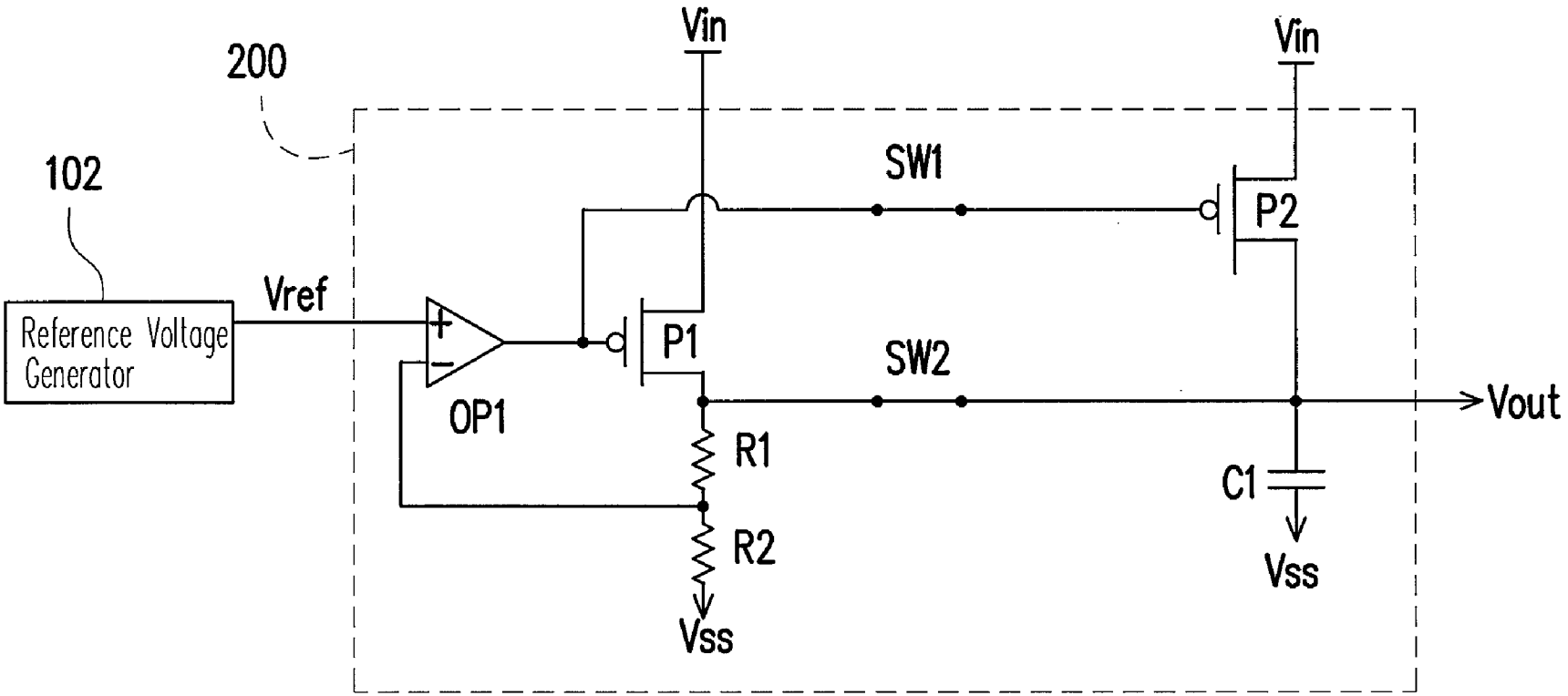
FIG. 2 is an equivalent circuit of FIG. 1 in a suspend mode.

Equivalent circuits of the suspend mode and the standby mode are described further below. FIG. 2 is the equivalent circuit of the voltage regulator 100 in the suspend mode according to the present embodiment of the present invention, wherein the equivalent circuit 200 of the suspend mode is the equivalent circuit of the voltage regulator 100 in the suspend mode. In the suspend mode, the first switch SW1 and the second switch SW2 are both turned on, the gate of the P-type transistor P1 is coupled to the gate of the P-type transistor P2, and the drain of the P-type transistor P1 is coupled to the drain of the P-type transistor P2, thereby increasing the current supply capacity of the equivalent circuit 200 of the suspend mode. For circuit analysis purpose, the P-type transistors P1, P2 can be considered one P-type transistor with a larger size.

In the suspend mode, the voltage regulator 100 can disable the current buffer 1062, i.e., disable the P-type transistor P3, P-type transistor P4, N-type transistor N1, current sources Ibias1, Ibias2, Ibias3 and the bias voltage Vbias1 to further reduce the power consumption.

Figure 3:
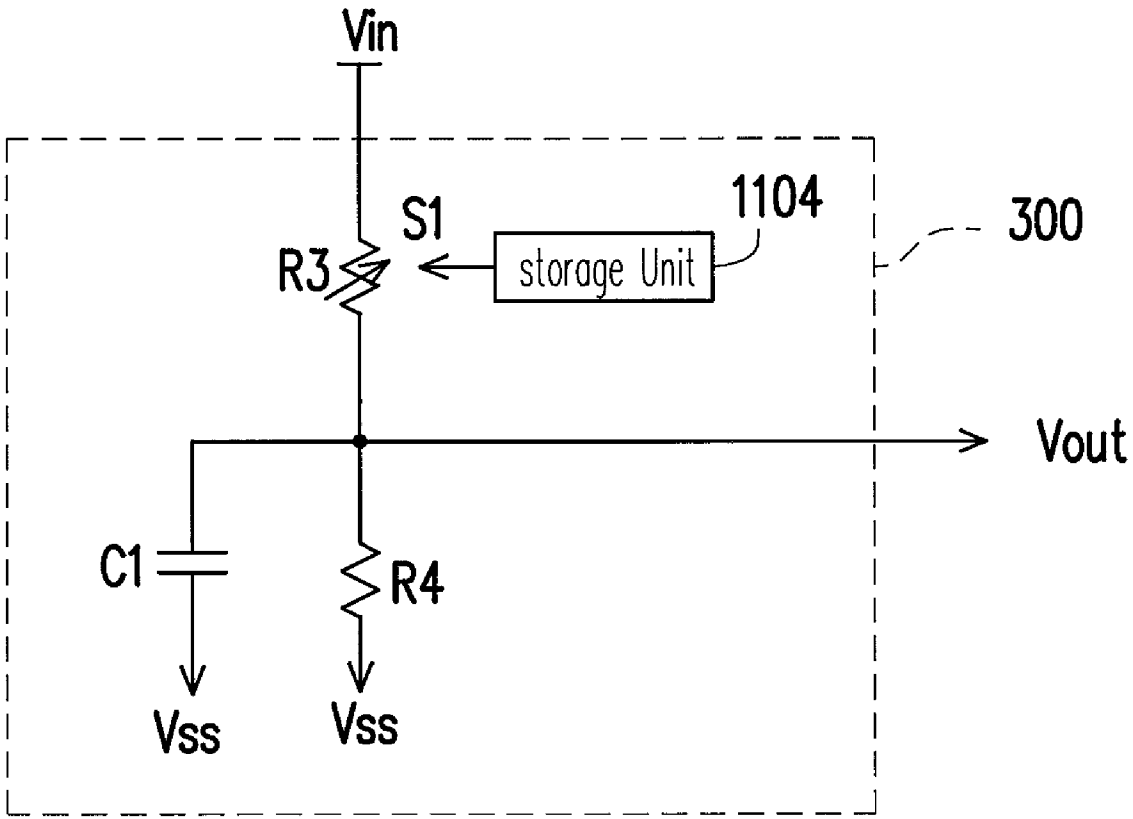
FIG. 3 is an equivalent circuit of FIG. 1 in a standby mode.

FIG. 3 is the equivalent circuit of the voltage regulator 100 in the standby mode according to the present embodiment of the present invention, wherein the equivalent circuit 300 of the standby mode is the equivalent circuit of the voltage regulator 100 in the standby mode. In the standby mode, the first voltage output unit 104 and the second voltage output unit 106 are disabled and the second switch SW2 is turned off. Thus, the voltage regulator 100 can be considered a pure resistor voltage division circuit in the standby mode.

The equivalent circuit 300 of the standby mode consumes even further lower power and only needs maintain the output voltage Vout via-the third voltage output unit 108. In other words, the output voltage in the standby mode can be close to the output voltage in the operation mode and the suspend mode, but the power consumption of the voltage regulator 100 can be minimized.

In summary, the voltage regulator of the present invention can provide an operation mode, a suspend mode and a standby mode which can be switched to provide corresponding current driving capacity for respective operation states. When in the operation mode, the voltage regulator can provide a great current, for example, about 100 mA, to the load. When in the suspend mode, the voltage regulator can consume less power and provide a smaller current, for example, about 1 mA, to the load. When in the standby mode, the voltage regulator can consume even less power, for example, less than 5 uA.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage regulator comprising:

a comparator having a first input end, a second input end, and an output end, the first input end used to receive a reference voltage;

a first voltage output unit comprising:

a first P-type transistor having a source coupled to an operating voltage, a drain coupled to a first resistor, and a gate coupled to the output end of the comparator; and a second resistor coupled between the other end of the first resistor and a ground, wherein a common node of the first resistor and the second resistor is coupled to the second input end of the comparator;

a second voltage output unit comprising:

a second P-type transistor having a source coupled to the operating voltage and a drain coupled to a capacitor, the other end of the capacitor coupled to the ground; and a current buffer coupled between the drain of the first P-type transistor and the drain of the second P-type transistor, an output end of the current buffer coupled to a gate of the second P-type transistor and adjusting the gate voltage of the second P-type transistor according to the drain voltage of the first P-type transistor and the drain voltage of the second P-type transistor;

a first switch coupled between the gate of the first P-type transistor and the gate of the second P-type transistor; and a second switch coupled between the drain of the first P-type transistor and the drain of the second P-type transistor.

2. The voltage regulator according to claim 1, further comprising a third voltage output unit, the third voltage output unit comprising:

a third resistor having one end coupled to a second operating voltage; and a fourth resistor coupled between the other end of the third resistor and the ground, wherein a common node of the third resistor and the fourth resistor is coupled to the drain of the second P-type transistor.

3. The voltage regulator according to claim 2, wherein the third resistor comprises a variable resistor, the third voltage output unit further comprises a comparison unit coupled to the variable resistor, the comparison unit comparing the second operating voltage with the reference voltage and outputting an adjustment signal to the variable resistor to adjust the resistance of the variable resistor.

4. The voltage regulator according to claim 3, wherein the comparison unit comprises:

a comparison circuit for comparing the second operating voltage with the reference voltage and outputting an adjustment value; and a storage device for storing the adjustment value and outputting the adjustment signal to the variable resistor according to the adjustment value to adjust the resistance of the variable resistor.

5. The voltage regulator according to claim 2, wherein when the first switch and the second switch are turned off, the voltage regulator is in an operation mode.

6. The voltage regulator according to claim 2, wherein when the first switch and the second switch are turned on, the voltage regulator is in a suspend mode.

7. The voltage regulator according to claim 6, wherein when the voltage regulator is in the suspend mode, the current buffer is disabled.

8. The voltage regulator according to claim 2, wherein when the first voltage output unit and the second voltage output unit are disabled and the second switch is turned off, the voltage regulator is in a standby mode.

9. The voltage regulator according to claim 2, wherein the current buffer comprises:

a third P-type transistor having a source coupled to the drain of the first P-type transistor and a drain coupled to a gate of the third P-type transistor and a first current source;

a fourth P-type transistor having a gate coupled to the gate of the third P-type transistor, a source coupled to the drain of the second P-type transistor, and a drain coupled to a second current source; and an N-type transistor having a gate coupled to a bias voltage, a drain coupled to a third current source and the gate of the second P-type transistor, and a source coupled to the drain of the fourth P-type transistor.

10. The voltage regulator according to claim 2, further comprising a reference voltage generator coupled to the first input end of the comparator for generating the reference voltage.

11. The voltage regulator according to claim 10, wherein the comparator is an operational amplifier, the first input end of the comparator is a non-inverting input end of the operational amplifier, and the second input end of the comparator is an inverting input end of the operational amplifier.

12. The voltage regulator according to claim 2, wherein the operating voltage is equal to the second operating voltage.

13. The voltage regulator according to claim 1, wherein the comparator is an operational amplifier, the first input end of the comparator is a non-inverting input end of the operational amplifier, and the second input end of the comparator is an inverting input end of the operational amplifier.

14. A voltage regulator comprising:

a comparator having a first input end, a second input end, and an output end, the first input end used to receive a reference voltage;

a first voltage output unit comprising:

a first P-type transistor having a source coupled to an operating voltage, a drain coupled to a first resistor, and a gate coupled to the output end of the comparator; and a second resistor coupled between the other end of the first resistor and a ground, wherein a common node of the first resistor and the second resistor is coupled to the second input end of the comparator;

a second voltage output unit comprising:

a second P-type transistor having a source coupled to the operating voltage and a drain coupled to a capacitor, the other end of the capacitor coupled to the ground; and a current buffer comprising:

a third P-type transistor having a source coupled to the drain of the first P-type transistor and a drain coupled to a gate of the third P-type transistor and a first current source;

a fourth P-type transistor having a gate coupled to the gate of the third P-type transistor, a source coupled to the drain of the second P-type transistor, and a drain coupled to a second current source; and an N-type transistor having a gate coupled to a bias voltage, a drain coupled to a third current source and a gate of the second P-type transistor, and a source coupled to the drain of the fourth P-type transistor;

a third voltage output unit comprising:

a third resistor having one end coupled to a second operating voltage; and a fourth resistor coupled between the other end of the third resistor and the ground, wherein a common node of the third resistor and the fourth resistor is coupled to the drain of the second P-type transistor;

a first switch coupled between the gate of the first P-type transistor and the gate of the second P-type transistor; and a second switch coupled between the drain of the first P-type transistor and the drain of the second P-type transistor.

15. The voltage regulator according to claim 14, wherein the third resistor comprises a variable resistor, the third voltage output unit further comprises a comparison unit coupled to the variable resistor, the comparison unit comparing the second operating voltage with the reference voltage and output an adjustment signal to the variable resistor to adjust the resistance of the variable resistor.

16. The voltage regulator according to claim 15, wherein the comparison unit comprises:

a comparison circuit for comparing the second operating voltage with the reference voltage and output an adjustment value; and a storage device for storing the adjustment value and output the adjustment signal to the variable resistor according to the adjustment value to adjust the resistance of the variable resistor.

17. The voltage regulator according to claim 14, wherein when the first switch and the second switch are turned off, the voltage regulator is in an operation mode.

18. The voltage regulator according to claim 14, wherein when the first switch and the second switch are turned on, the voltage regulator is in a suspend mode.

19. The voltage regulator according to claim 18, wherein when the voltage regulator is in the suspend mode, the current buffer is disabled.

20. The voltage regulator according to claim 14, wherein when the first voltage output unit and the second voltage output unit are disabled and the second switch is turned off, the voltage regulator is in a standby mode.

21. The voltage regulator according to claim 14, further comprising a reference voltage generator coupled to the first input end of the comparator for generating the reference voltage.

22. The voltage regulator according to claim 21, wherein the comparator is an operational amplifier, the first input end of the comparator is a non-inverting input end of the operational amplifier, and the second input end of the comparator is an inverting input end of the operational amplifier.

23. The voltage regulator according to claim 14, wherein the operating voltage is equal to the second operating voltage.

24. The voltage regulator according to claim 14, wherein the comparator is an operational amplifier, the first input end of the comparator is a non-inverting input end of the operational amplifier, and the second input end of the comparator is an inverting input end of the operational amplifier.

* * * * *